United States Patent [19]

Tomita et al.

[11] 4,042,898

[45] Aug. 16, 1977

[54] POLE PIECE FOR USE IN MAGNET DEVICE AND METHOD FOR MANUFACTURING SAME

[75] Inventors: Sadami Tomita, Katsuta; Akio Chiba, Hitachi, both of Japan

[73] Assignee: Hitachi, Ltd., Japan

[21] Appl. No.: 556,887

[22] Filed: Mar. 10, 1975

[30] Foreign Application Priority Data

Mar. 13, 1974 Japan ..... 49-28071

[51] Int. Cl.[2] ..... H01F 3/00

[52] U.S. Cl. ..... 335/297; 148/39

[58] Field of Search ..... 335/296, 297; 148/12 A, 148/31.55, 39, 112, 120, 121

[56] References Cited

U.S. PATENT DOCUMENTS

| | | | |
|---|---|---|---|
| 1,767,653 | 6/1930 | Davis | 148/39 |
| 2,777,099 | 1/1957 | Foss | 335/297 |
| 3,118,795 | 1/1964 | Kolbe et al. | 148/120 X |

FOREIGN PATENT DOCUMENTS

| | | | |
|---|---|---|---|
| 1,174,947 | 12/1969 | United Kingdom | 335/296 |

*Primary Examiner*—George Harris

*Attorney, Agent, or Firm*—Craig & Antonelli

[57] ABSTRACT

A pole piece for use in a magnet device and a method for manufacturing same, in which the structure of the pole piece for use in a magnet device used in an analyzing apparatus for analyzing such as nuclear magnetic resonance is varied in concentric fashion from the center towards the outer circumference of the pole piece. The pole piece is manufactured according to the die-forging, whereby the magnetic properties of the pole piece become hetrogenous in concentric fashion. The use of such a pole piece brings about a magnet device which is compact in size and which provides a strong and uniform magnetic field.

17 Claims, 23 Drawing Figures x 1/2 x 1/2 x 1/2 x 1/2 x1 x120 x1 x120 x1 x120 x1 x120

POLE PIECE FOR USE IN MAGNET DEVICE AND METHOD FOR MANUFACTURING SAME

BACKGROUND OF THE INVENTION

1. Field of the Invention

This invention relates to improvements in uniformity in the magnetic gap field distribution in a magnet device which is used in an analyzing apparatus for analyzing such as nuclear magnetic resonance, and more particularly to improvements in a pole piece for use in the aforesaid magnet device and a method for manufacturing same.

2. Description of the Prior Art

An atomic nucleous or electron has a magnetic moment due to its rotation on its axis. Thus, when the atomic nucleus or electron is placed in a high magnetic field which has been generated by a magnet and oriented in a given direction consistently, then there takes place polarization in the direction of the magnetic field thereof. If a high frequency magnetic field is applied to the atomic nucleus or electron in the polarized condition in the direction at a right angle to the polarizing direction by means of coils, then the nucleus or electron precession occurs in the magnetic field, thereby causing rotation of a magnetic moment having the same angular velocity as that of the high frequency magnetic field applied. As a result, there takes place variation in voltage between the coils, on which the high frequency magnetic field has been impressed, so that the aforesaid variation in voltage may be detected as signals.

An analyzing apparatus for analyzing nuclear magnetic resonance utilizes the aforesaid principle to detect the condition of the atomic nucleus or electron in a material. This apparatus is known as being advantageous for clarifying the bonding condition of atomic nucleus or electron or the molecular construction of a compound, because of its extremely high resolving power.

A circular frequency $\omega$ for magnetic resonance is given by $\omega = \gamma H$, wherein $\gamma$ represents a gyromagnetic constant and $H$ represents the intensity of a polarized magnetic field. As can be seen from this formula, if the magnetic field in a sample space becomes uneven, then there results variation in magnetic resonance frequency in the respective portions of the sample, so that the range of resonance signals will be broader, with the resulting reduction in resolving power. On the other hand, the fact that the polarized magnetic field is intense signifies that the resonance frequency is high, thus presenting advantages from viewpoints of the separation of frequency and the signal-to-noise ratio. Accordingly, a magnet device which provides extremely uniform and strong magnetic field is required for the unclear magnetic resonance analyzing apparatus.

In the practical application, there has arisen a demand for magnet device which presents a magnetic-gap-field instensity ranging from several thousands Oe to several hundred thousands Oe, as well as a uniform magnetic field having a variation of less than $1 \times 10^{-5}$.

A pole piece is used for such a magnet device for the purpose of collecting magnetic fluxes in the gap portion of a magnet to thereby increase the intensity of a magnetic gap field. It is a common practice to use as a material for a pole piece a magnetic material having a high magnetic flux density and magnetically uniform composition. According to the prior art method for manufacturing such a pole piece, the starting material is melted to provide an ingot, and then the ingot thus prepared is subjected to hot forging and hot rolling to thereby provide a billet. Then, the billet is machined by means of a lathe to a shape of the pole piece desired, followed by heat treatment. The magnetic properties of the pole piece thus obtained is uniform throughout the pole piece, and such properties have been required.

The uniformity in a magnetic gap field depends on the surface-magnetic-charge distribution, while it also depends on the magnetic properties of a material use, the shape of a pole piece, i.e., the gap/diameter ratio, and the tapered angle of the tip of the pole piece.

With the conventional pole piece, the diameter of the pole piece is increased for enhancing the uniformity in the magnetic gap field, because the uniformity in the magnetic field of a space confined by the parallel surfaces having infinite areas is ideal. For those reasons, a pole piece of a size excessively large for a sample space, for instance, the pole piece having a diameter of 200 mm, is used for the sample space of $5 \times 5 \times 5$ mm. The increase in size of the pole piece results in an increase in size of a magnet, i.c., a magnetic-motive-force-generating portion, so that the weight of the entire magnetic device is increased to as high as 4 tons.

As an alternative, there has been proposed a method for improving uniformity in a magnetic field, wherein a magnetic ring is fitted on the outer periphery of the pole piece. However, such a method suffers from disadvantages that there is considerable discontinuity in the surface-magnetic-charge distribution on the boundary of the aforesaid fitted portion, with the result that there takes place microscopic non-uniformity in the magnetic gap field, thus failing to present desired uniformity for magnetic field.

Still alternatively, there has been proposed a method, by which to provide a spherical surface for a pole piece. However, the polishing level required for the spherical surface is far from practicality.

SUMMARY OF THE INVENTION a. Objects of the Invention

It is an object of the present invention to provide a pole piece for use in a magnet device, which is compact in size and yet generates a strong magnetic field.

It is another object of the present invention to provide a pole piece for use in a magnet device, which is compact in size and presents excellent uniformity in a magnetic gap field.

It is a further object of the present invention to provide a method for manufacturing in an efficient manner a pole piece which may satisfy the aforesaid objects.

b. Summary

According to the present invention, there is provided a pole piece for use in a magnet device and a method for manufacturing same, wherein the crystal structure of a starting material is adjusted according to the characteristics of a magnetic gap field of the magnet device for varying the magnetic characteristics of the pole piece in an attempt to improve the uniformity in a magnetic gap field.

DESCRIPTION OF THE PREFERRED EMBODIMENTS

The conventional pole piece features the uniformity in the magnetic characteristics in terms of its location. In contrast thereto, the pole piece according to the present invention presents different magnetic characteristics depending on the center portion and the outer circumferential portion thereof, thus featuring the improved uniformity in a magnetic field in a predetermined space, as compared with the case of the uniform magnetic field obtained irrespective of the location. What is meant by the magnetic characteristics of a pole piece as used herein is permeability or coercive force. The difference in permeability or coercive force depending on the center portion and the outer circumferential portion of a pole piece dictates the variation in crystal grain size, internal stress, distribution in impurities, alignment of direction of crystals (an aggregated structure) in terms of location. One of solutions for this is to manufacture a pole piece according to die-forging in a manner to provide heavy plastic working and light plastic working for the pole piece. In such a case, the portion which has been subjected to heavy plastic working presents a fine crystal structure, which in turn presents lower permeability, as compared with those in the other portions, presenting a greater coercive force. If the permeability is lowered, then there results difficulty in magnetic flux passing therethrough, with the accompanying decrease in the surface-magnetic charge. Another possible attempt is to utilize the thermal strain or to prepare a locally recrystallized structure. However, those attempts are expected to encounter difficulties in the practical application. In contrast thereto, the die-forging method aforesaid is considered to be of much promise, because of the simplicity which will be described in more detail hereinafter.

Figure 1:
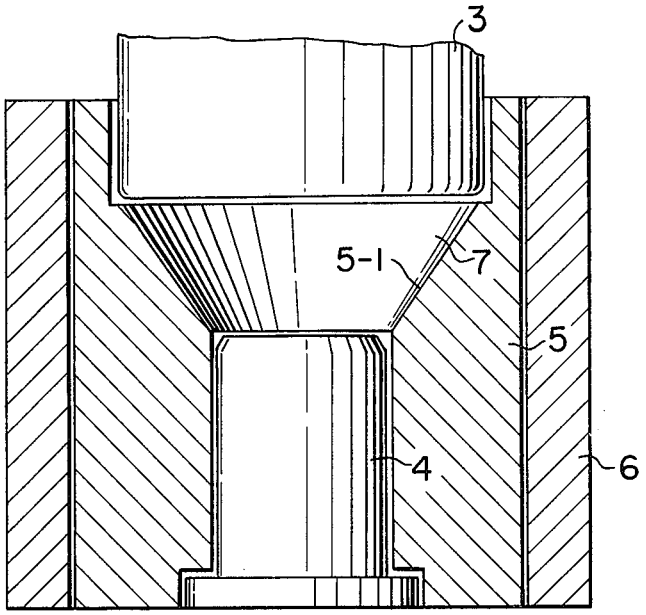
FIG. 1 is a cross-sectional view of forging dies which are used for manufacturing a pole piece according to the present invention.

FIG. 1 illustrates the longitudinal cross-sectional view of forging dies to manufacture the pole piece according to the present invention. Description will now be given of the manufacturing method for a pole piece according to the present invention in conjunction with FIG. 1. Shown at 3 is an upper punch die, at 4 a lower punch die, at 5 a side wall of dies, at 6 a die-holding frame and at 7 a space for a pole-piece stock. Firstly, iron-cobalt base alloy forging stock of a plate form, which is referred to as a high standard value alloy, is placed in the pole piece stock space 7. In this condition, the upper punch die 3 is dropped from above, with heat being applied thereto, so that the pole piece is lowered, with its lower edge sliding on a sloped surface 5-1 of the side wall 5 of the forging die. As the punching proceeds, the lower edge surface of the stock will assume the same shape as that of the upper edge surface of the lower punch 4. The pole piece stock thus forged substantially to a desired shape is withdrawn from the forging dies, followed by the accurate machining to an intended shape and polishing.

The difference in crystal grain-size of the respective portions of the surface of a pole piece depends on the gradient of the sloped surface 5-1, the tip configuration of the lower punch die 4, the shape of the pole piece stock and the like. The test reveals that it may be achieved with ease to obtain the ratio of grain size of about 1 : 4 (1 : 1.3 in terms of permeability).

The ratio of the permeability of the respective portions of a pole piece should depend on the variation-rate-characteristic curve of the magnetic gap field of a magnetic device, in which the pole piece is built.

The following examples are illustrative of the features of the pole piece and a method for manufacturing same according to the present invention.

EXAMPLE

An ingot as a forging stock of a pole piece was prepared by subjecting to vacuum melting an alloy containing, in weight percent, 0.5%; Mn, 22% V, 46% Co, and the balance essentially Fe. After machining to remove its skin, the ingot was heated to a temperature of 1100° to 1150° C in a heavy-oil furnace, and then forged at a temperature maintained at no less than 950° C to thereby provide a round bar of a diameter of 90 mm $\phi$. Then, the round bar was cut in round slice to give disks of a diameter of 87 mm and a thickness of 24 mm as a forging stock for the pole piece.

Then, the forging stock thus prepared was subjected to stamping to obtain a desired shape of a pole piece by using a DYNAPAK forging machine, Model 620 CAMY made by General Dynamics Company. The forging conditions were such that the heating temperature was 1100° C, forging energy 3 ton·m and the atmosphere an argon gas. Furthermore, the pole piece thus forged was subjected to machining into a pole piece of a desired shape and then to heat treatment at a temperature of 900° C for 3 hours under argon atmosphere, thus completing the manufacture of the pole piece.

FIG. 3 shows the shape of a pole piece which was prepared according to the die-forging, with the configuration of the lower punch die varied, and FIGS. 4*a* to 4*d* show the surface structures of the pole piece stocks, after the convex portions thereof have been machined.

Figure 4A:
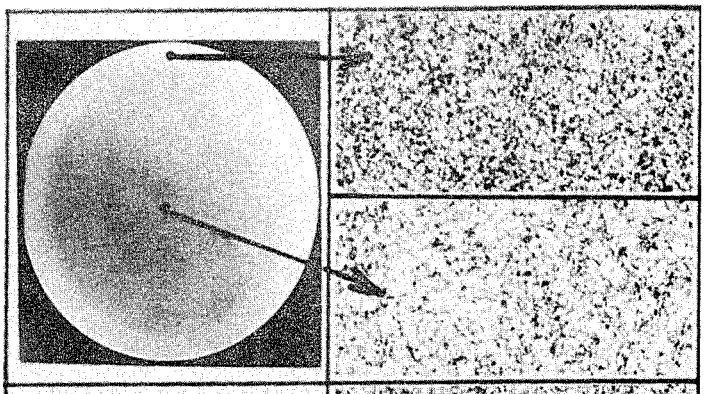
FIGS. 4*a* to 4*d* are microphotographs of the macro-structures of the cross sections and the micro-structures of the various portions, of the pole pieces of FIGS. 4*a* to 4*d*, (in which the reference characters (*a*) to (*d*) therein correspond to (*a*) to (*d*) for the configurations of the lower punch dies of FIGS. 2*a* to 2*d*.

The study on the pole piece which was prepared by using the lower punch die having a configuration shown in FIG. 4*a* reveals that the edge portion of the surface of the pole piece has been subjected to heavy plastic working, and that, as it goes towards the center thereof, the degree of the plastic working is decreased. As has been described earlier, the portion subjected to heavy plastic working presents a fine crystal structure with the accompanying lower permeability, providing lowered magnetic charge thereat. Accordingly, in such a case, it will be understood that the double-hump character of the magnetic gap field is corrected and its curve is flattened. Apparently, for correcting the single hump character and flattening the curve, it is necessary that, in contrast thereto, the edge portion of the pole piece be subjected to a small degree of plastic working, i.e., the center portion thereof be subjected to heavy plastic working.

Figure 4B:
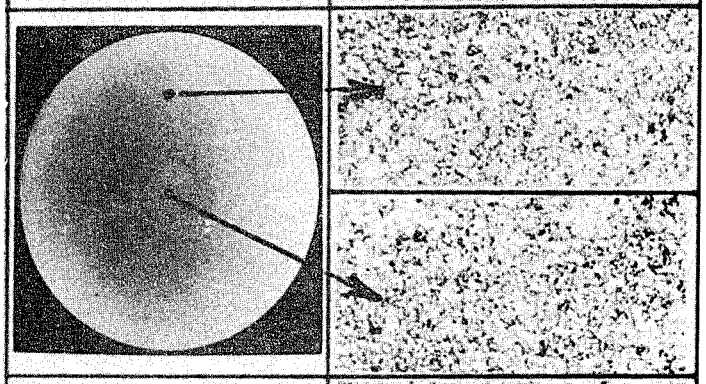
Figure 4C:
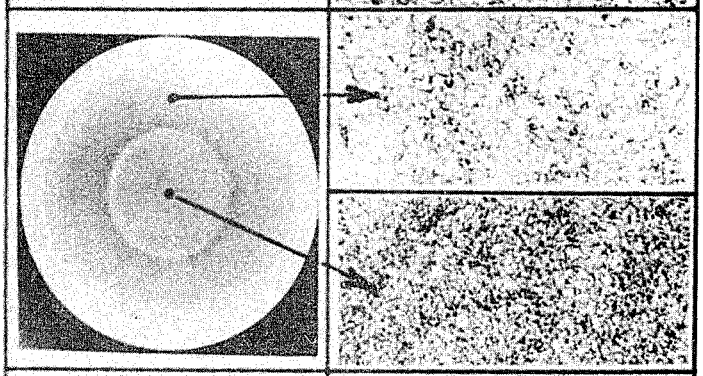
Figure 4D:
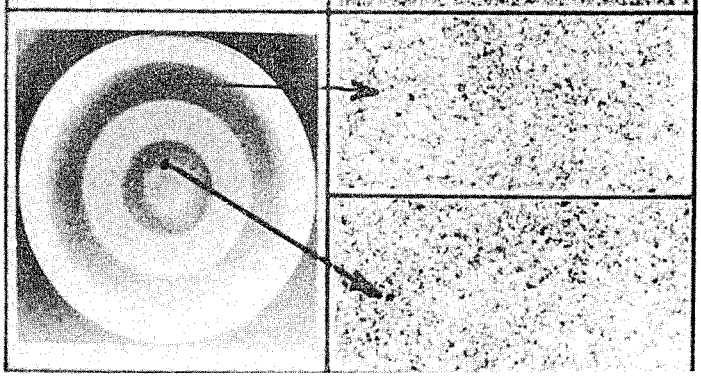

When using a lower punch die as shown in FIG. 4*b*, the outer circumferential portion corresponding to the cavity in the lower punch die is subjected to a heavy plastic working, and thus a fine crystal structure will result. The center portion and outer circumferential portion of the pole piece which has been subjected to the plastic working by means of a lower punch die of FIG. 4*c* are subjected to heavy plastic working, with the resulting fine crystal structure, presenting three annular rings as is best shown in FIG. 4*c*. On the other hand, the lower punch die has cavities of an increased depth, thus presenting a surface of a crystal structure having five annular rings as is best shown in FIG. 4*d*.

Such portions of the surface of the pole piece which are to face the convex portions of the lower punch die will be subjected to light plastic working, while the portions which correspond to the concave portions of the lower punch die will be subjected to heavy plastic working. The crystal structure of the portions which have been subjected to heavy plastic working correspond to the white portions of the macro-structure as shown in FIG. 4*a* to 4*d* and present fine grain sizes as shown in the micro-structures shown in FIGS. 4*a* to 4*d*. On the other hand, the crystal structures corresponding to the black portions in FIGS. 4*a* to 4*d* present rough grain sizes. Thus, such fine crystal grains and rough crystal grains provide annular ring structures in concentric fashion. In this manner, by varying the dimensions of the lower punch die, the crystal structure on the surface of the pole piece may be varied as required.

Figure 2A:
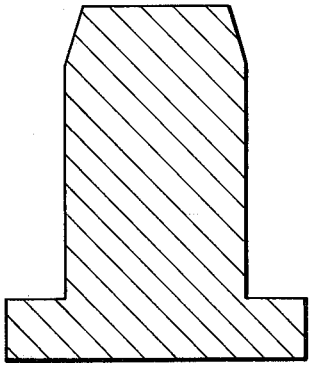
FIGS. 2*a* to 2*d* are longitudinal cross-sectional views of the configurations of various kinds of lower punch dies.
Figure 2B:
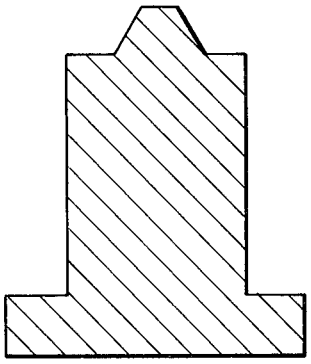
Figure 2C:
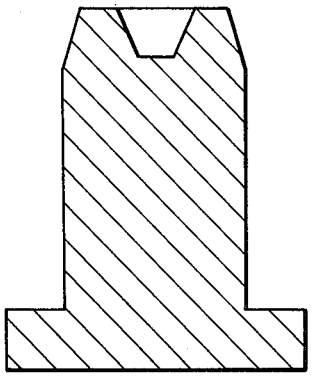
Figure 5:
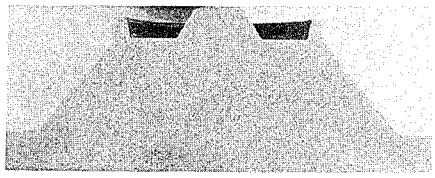
FIG. 5 is a microphotograph of the macro-structure of the longitudinal cross-section of a pole piece of FIG. 3*c*.
Figure 6A:
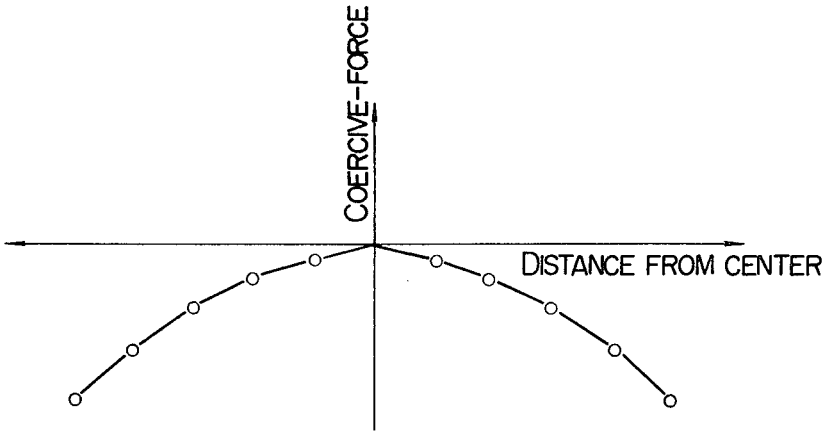
FIGS. 6*a* to 6*d* are plots illustrating the coercive-force distributions of the respective pole pieces of FIGS. 3*a* to 3*d*, in each of which the distance from the center of the pole piece is represented as an abscissa and the coercive force is represented as an ordinate.
Figure 6B:
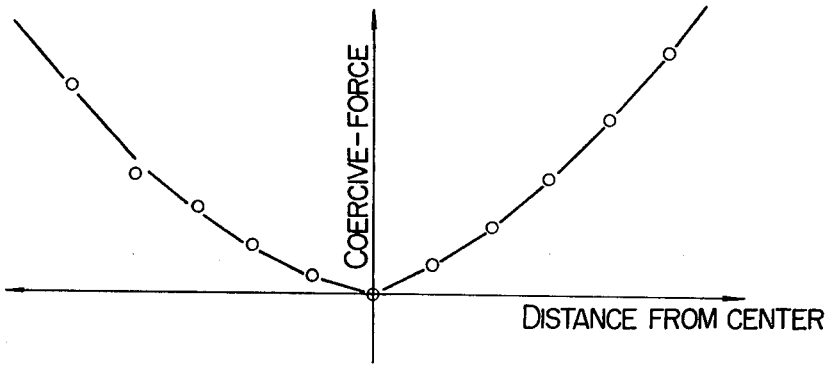
Figure 6C:
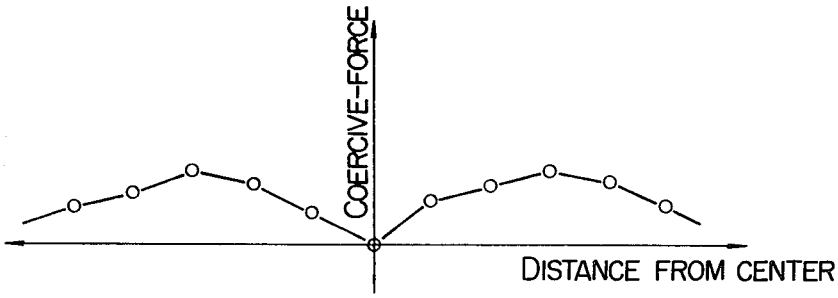
Figure 6D:
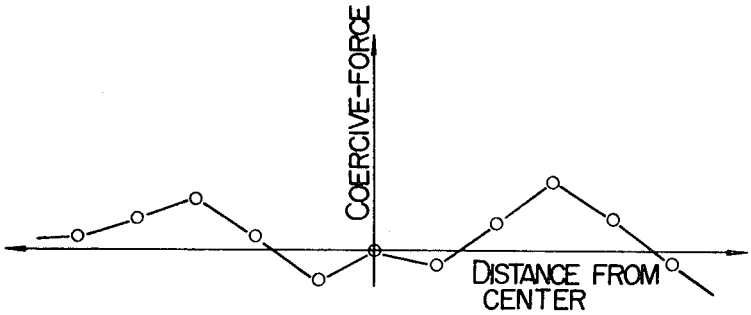

FIG. 5 shows the longitudinal cross-sectional structure of a pole piece prepared by using the lower punch die given in FIG. 2*c*. The white stripes shown represent the direction of working, and the aggregated portion of the stripes represent heavy plastic working. As can be seen from this, heavier plastic working presents such a portion of the interior of a pole piece which corresponds to the convex portion of a punch die, while such a tendency is further enhanced, as it goes closer to the convex portion of the pole piece.

Figure 2D:
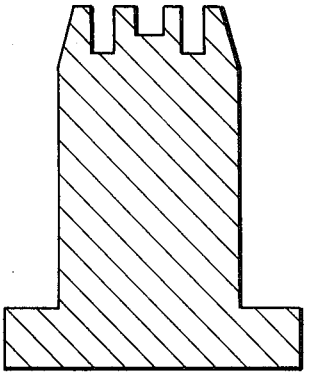
Figure 3A:
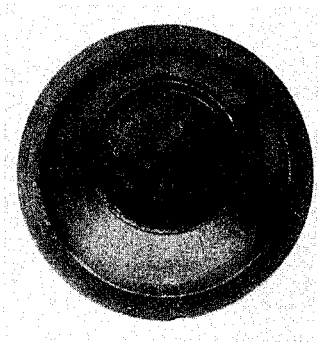
FIGS. 3*a* to 3*d* are views illustrating the configurations of pole pieces which are formed according to a die-forging process by the use of the lower punch dies shown in FIGS. 2*a* to 2*d* (in which the reference characters) (*a*) to (*d*) correspond to (*a*) to (*d*) for the configurations of the lower punch dies)
Figure 3B:
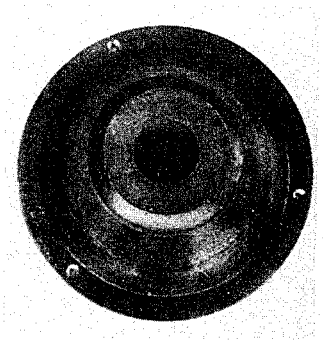
Figure 3C:
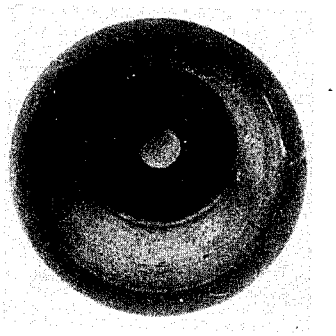
Figure 3D:
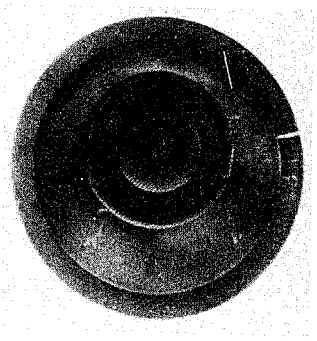
Figure 7:
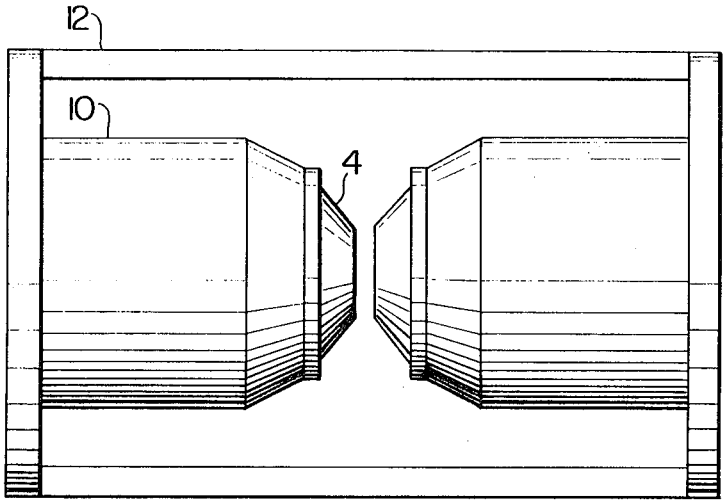
FIG. 7 is an outline showing the magnet device, in which a pole piece according to the present invention is built.
Figure 8A:
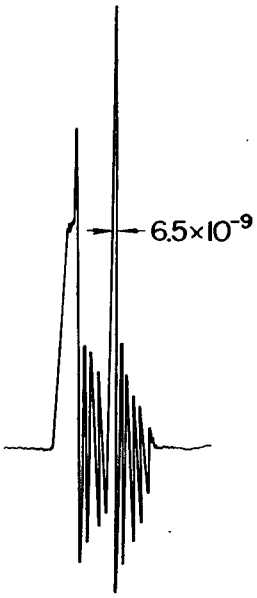
FIGS. 8*a* to 8*c* and 8*x* show the wave forms of absorption signals which have been obtained according to the measurements of nuclear magnetic resonance absorption signals of water, while the pole pieces prepared by means of lower punch dies of FIGS. 2*a*, 2*b* and 2*c* have been built in the nuclear magnetic resonance apparatus. The wave forms shown in FIG. 8*x* represents the absorption signals of water in case the pole piece manufactured according to the prior art method are built in the aforesaid apparatus and presented for a comparison purpose.
Figure 8B:
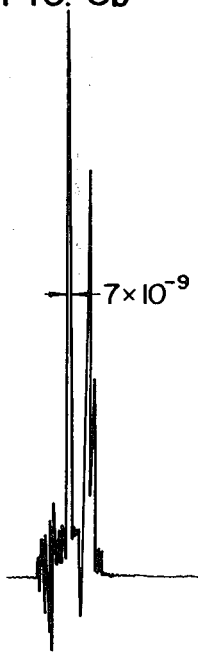
Figure 8C:
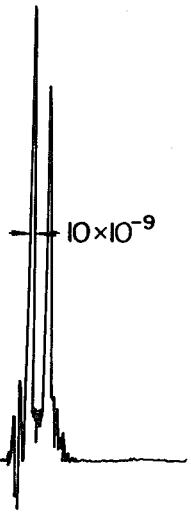
Figure 8X:
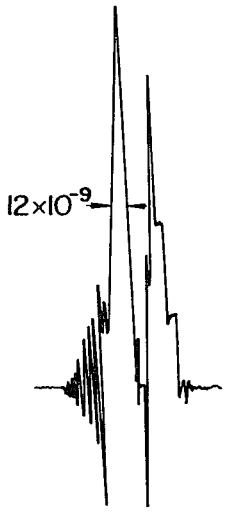

Next, the coercive forces were measured for the surfaces of the pole pieces which have been prepared, with the configurations of the lower punch dies being varied as shown in FIGS. 2*a* to 2*d* by using a non-destructive magnetism measuring device. (In this device, a coercive force is accurately measured by means of an elastic-motion galvanometer which measures the variation in the magnetic flux of closed magnetic circuits which are formed by both a 'C' type iron core and the surface of a material to be measured.) FIGS. 6*a* to 6*d* show the results of such measurements. As can be seen from FIGS. 6*a* to 6*d*, the coercive force of a pole piece which has been prepared by using the lower punch die of FIG. 2*a* is great. However, the pole piece which has been prepared by using the lower punch die of FIG. 2*b* presents a low coercive force in its center portion. Furthermore, the pole piece which has been prepared by using the lower punch die of FIG. 2*c* presents a great coercive force in its middle portion. Still furthermore, the pole piece which has been prepared by using the lower punch die of FIG. 2*d* presents a low coercive force in its center portion but a peaked coercive force in its very center. FIG. 7 shows an outline of a magnet for use in the nuclear magnetic resonance and dimensions of a pole piece. In the drawing, connected to the opposite ends of an Alnico magnet 10 are a pole piece 4 and a yoke 12. FIGS. 8*a* to 8*c* and 8*x* show the nuclear magnetic resonance absorption signal wave forms of water, the waveforms having been obtained by using a nuclear magnetic resonance analyzing apparatus, in which has been built the aforesaid pole pieces. In the case of the use of pole pieces prepared by using the lower punch dies of the types of FIGS. 2*a* and 2*b*, the apparatus presented an excellent resolving power for the signal waveform obtained by using a pole piece having a uniform crystal structure as well as magnetic characteristics as shown in FIG. 8*x*. On the other hand, the apparatus presented an excellent resolving power in the case of the use of a pole piece which has been prepared by using a lower punch die of a configuration shown in FIG. 2*c*.

As can be seen from the foregoing description, the resolving power for a resonance signal, which has been obtained according to the present invention, was proved to be much improved. This however can be attributed to the uniformity in the magnetic gap field. Furthermore, the adoption of the pole piece according to the present invention permits to render the diameter of a magnet smaller, with the accompanying decrease in size of a yoke and the like, so that the entire magnet device according to the present invention may be reduced in size to about $\frac{1}{3}$ and in weight to about 1/10 of those of the conventional device.

As is apparent from the foregoing description, the objects of the present invention have thus been achieved, with the resulting many highly evaluated advantages.

Waht is claimed is:

1. A pole piece for use in a magnet device, characterized in that the crystal structure of the surface of said pole piece is different depending on the center portion and the outer circumferential portion of said pole piece.

2. A pole piece for use in a magnet device, characterized in that the crystal structure of the surface of said pole piece is different depending on the center portion and the outer circumferential portion of said pole piece, wherein the outer circumferential portion of said pole piece has a fine crystal structure, while the center portion thereof has a rough crystal structure.

3. A pole piece for use in a magnet device as set forth in claim 2, wherein the ratio in the crystal grain size of said fine crystal structure to said rough crystal structure is 1 : 4.

4. A pole piece for use in a magnet device, characterized in that the crystal structure of the surface of said pole piece varies in an annular ring fashion from its center towards its outer circumference.

5. A method of manufacturing a pole piece for use in a magnet device, comprising the step of using die-forging, whereby a fine crystal structure is obtained by applying heavy plastic working, while a rough crystal structure is obtained due to light plastic working.

6. A method of manufacturing a pole piece for use in a magnet device as set forth in claim 5, wherein the degree of plastic working is adjusted by utilizing the configuration of a lower punch die.

7. A method for manufacturing a pole piece for use in a magnet device as set forth in claim 5, wherein the portion of said pole piece, which has been subjected to heavy plastic working, is obtained by means of a concave portion of said lower punch die while the portions of said pole piece, which has been subjected to light plastic working, is obtained by means of a convex portion of said lower punch die.

8. A unitary pole piece for use in a magnet device, comprising at least two regions, a first of said at least two regions being substantially continuous along the circumferential direction of the pole piece, said first region having a crystal structure different in grain size from the crystal structure of a second of said at least two regions, wherein said first region has a fine grain size crystal structure and said second region has a rough grain size crystal structure, and wherein the magnetic permeability of said first region is substantially lower than that of said second region.

9. A unitary pole piece as defined in claim 8, wherein said first region is positioned at the outer peripheral portion of the pole piece, and said second region is positioned in the central portion of the pole piece.

10. A unitary pole piece as defined in claim 9, wherein the ratio in the crystal grain size of said fine crystal structure to said rough crystal structure is 1 : 4.

11. A unitary pole piece as defined in claim 8, wherein said first region of the fine grain size crystal structure is formed by die-forging of a material for said pole piece.

12. A unitary pole piece as defined in claim 11, wherein said first region is positioned in the outer peripheral portion of the pole piece, and said second region is positioned in the central portion of the pole piece.

13. A unitary pole piece as defined in claim 12, wherein the ratio in the crystal grain size of said fine crystal structure to said rough crystal structure is 1 : 4.

14. A unitary pole piece as defined in claim 8, wherein a plurality of said regions are concentrically provided in the surface of the pole piece, each of said plurality of concentric regions having crystal structures of different grain sizes, wherein at least one of said plurality of regions has said fine grain structure and at least another of said plurality of regions has said rough grain structure.

15. A unitary pole piece as defined in claim 14, wherein three concentric regions of different grain sizes are provided with said three regions having alternate fine and rough grain sizes.

16. A unitary pole piece as defined in claim 14, wherein five concentric regions of different grain sizes are provided with said five regions having alternate fine and rough grain sizes.

17. A unitary pole piece as defined in claim 8, wherein said regions are provided in the surface of the pole piece.

* * * * *